United States Patent [19]

Shea et al.

[11] 3,959,943

[45] June 1, 1976

[54] RIVETED CELLULAR PANEL ASSEMBLY

[75] Inventors: Yale R. Shea, Hales Corner; Arthur B. Thelen; H. William Parsons, both of Milwaukee, all of Wis.

[73] Assignee: INRYCO, Inc., Melrose Park, Ill.

[22] Filed: Jan. 23, 1975

[21] Appl. No.: 543,319

[52] U.S. Cl. ..... 52/618; 52/619

[51] Int. Cl.[2] ..... E04B 2/28; E04C 2/32

[58] Field of Search ..... 52/332–334, 52/618, 619, 625

[56] References Cited

UNITED STATES PATENTS

| | | | |
|---|---|---|---|
| 3,059,734 | 10/1962 | Tripp | 52/618 X |
| 3,102,611 | 9/1963 | Mote | 52/332 X |
| 3,129,793 | 4/1964 | Ferrell | 52/618 X |
| 3,290,845 | 12/1966 | Snyder | 52/625 X |
| 3,363,379 | 1/1968 | Curran | 52/334 |
| 3,394,514 | 7/1968 | Lindner | 52/618 X |
| 3,669,821 | 6/1972 | Sharp | 52/625 X |

*Primary Examiner*—J. Karl Bell

*Attorney, Agent, or Firm*—Merriam, Marshall, Shapiro & Klose

[57] ABSTRACT

Cellular floor panel assembly is made by precoating one or more metal sheets with anti-corrosion paint or similar protective covering, then forming a fluted first plate and a flat or fluted second plate and connecting the plates in face-to-face contact with rivet-like fasteners. In a preferred embodiment, the structure is formed of a single sheet folded to form upper and lower sections.

10 Claims, 10 Drawing Figures

RIVETED CELLULAR PANEL ASSEMBLY

This invention relates to an improved cellular floor panel assembly made from prepainted metal sheets, which are formed into appropriate configuration assemblies, and fastened by means such as rivets, and to the resulting cellular floor panel assembly. In a preferred embodiment of the invention, the assembly is formed of a single sheet of material which is folded into the proper form and provided with appropriately positioned ribs for increasing the stiffness of the resulting assembly, thus minimizing the number of the rivets which must be used.

The use of poured concrete floors in structures such as office buildings has become quite common. In general such floors comprise a cellular floor panel assembly over which a concrete slab is poured, the cells of the assembly providing access passageways for electrical and communications lines. Such assemblies are typically formed of two galvanized sheet panels, including an essentially flat panel and a configurated panel in contact therewith, the latter having formed therein a series of inverted troughs which together with the flat panel define longitudinally extending parallel passageways through which power or communication lines can be installed. In the construction of such assemblies, it is conventional to join together the individual panels by means of resistance spot welds spaced at close intervals. In such use, the galvanized coating on the sheet metal provides a degree of protection which is generally not required by the severity of the conditions to which the assemblies are exposed. To the extent that the corrosion resistance afforded by the galvanized coating is not required, a condition which obtains in most such installations, the use of galvanized metal represents an inefficient use of natural resources and an unnecessary expense.

It has been found that adequate protection for such cellular floor assemblies can be provided by a coating of an appropriate paint or other non-metallic electrically non-conductive material. The use of paint or similar coatings, however, presents two difficulties in connection with the fabrication of such cellular floor assemblies. The first of these problems arises from the fact that access to the interior of the formed raceways for the application of paint after fabrication of the assembly is a difficult procedure. The second problem arises from the fact that paint and similar coatings are electrically non-conductive, thus creating difficulty in the use of the conventional electric resistance welding commonly used in fabricating these units.

The present invention solves both of these problems by employing sheet metal which is painted or otherwise coated on both sides prior to fabrication and by using mechanical fasteners such as rivets instead of welding to fasten the components together. Although the cost of a single rivet is higher than that of a single spot weld, the invention minimizes the number of rivets necessary to produce a suitably rigid structure by the use of appropriately spaced ribs which act as stiffeners and thus permit the production of a structure having suitable rigidity with a minimum number of rivets. In a particularly preferred embodiment, the assembly of the invention is made from a single sheet of material which is appropriately formed and folded to produce the desired structure in an economical and efficient manner.

The invention will be better understood from the following detailed description thereof, taken in conjunction with the accompanying drawings, in which.

Figure 6:
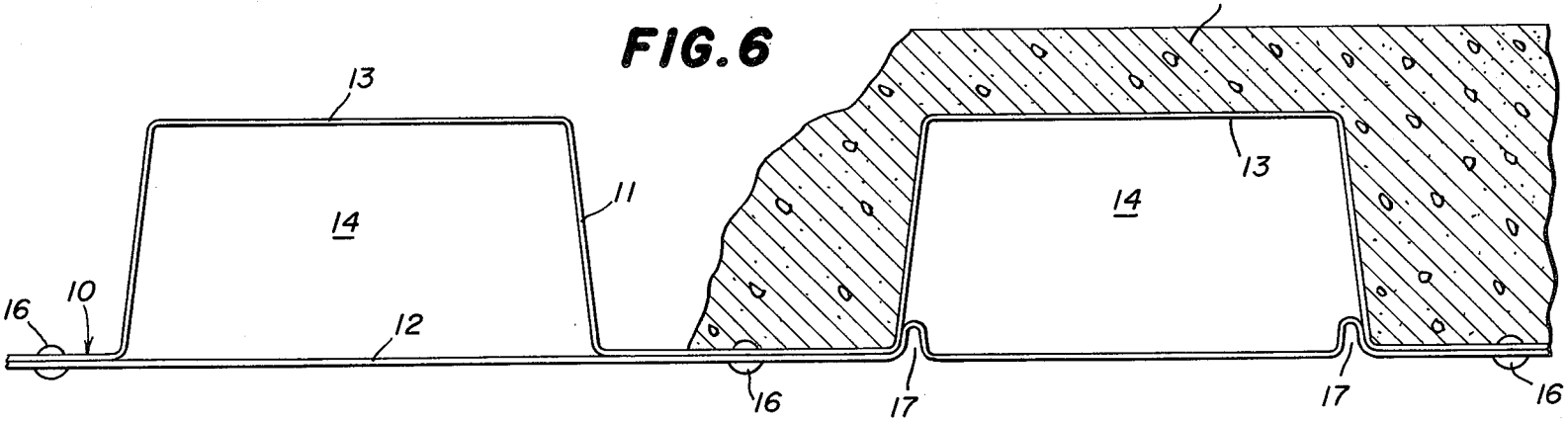
FIG. 6 is a partial sectional end view of another embodiment of the invention as installed in a poured concrete floor.

As illustrated in FIG. 6, in one embodiment the invention comprises an assembly 10 formed of an upper fluted plate 11 and a lower generally flat base plate 12 in contact therewith. Upper plate 11 is provided with a plurality of inverted troughs 13, the lower surfaces of which are in contact with base plate 12, thereby defining parallel elongated enclosed cells 14. In the areas of contact between fluted plate 11 and base plate 12, the plates are joined together with mechanical fasteners such as rivets 16 suitably placed along the length of the cellular structure. In order to minimize the number of rivets 16 required for rigidity in the structure, base plate 12 is advisably provided with one or more ribs 17 at the line of juncture between the edge of trough 13 and base plate 12. Stiffening ribs 17 serve not only to position properly the fluted plate 11 against base plate 12 but also act in conjunction with the rivets to provide adequate stiffness in the structure. In this manner, the total number of rivets and the size of the ribs can be held to a minimum.

Although not shown in FIG. 6 because of scale limitations, both surfaces of the metal sheets forming fluted plate 11 and base plate 12 are coated with a suitable protective coating such as an appropriate paint which applied to the sheet metal before the configurated shapes are formed. While such protective coatings would generally interfere with joining the fluted plate and the base plate by electric welding in conventional fashion, this difficulty is obviated by the use of rivets 16, which serve as a convenient and effective means for joining the plates forming the cellular assemblies.

Although the structure of FIG. 6 has been shown as comprising a fluted upper plate and a flat lower plate, it should be understood that the invention is not limited to this type of configuration. Also included within the scope of the invention are structures in which the upper plate is generally flat and the lower plate fluted, as well as those in which both the upper and lower plates are fluted.

In a typical installation, the cellular assembly of FIG. 6 is covered with a layer of concrete 18, in contact with fluted plate 11. The protective coating on the sheet metal serves to guard against corrosion caused by contact with the concrete. In addition, the interiors of cells 14 which also contain protective coatings are guarded against corrosion which might result from leakage of moisture from the concrete into the raceway.

Figure 1:
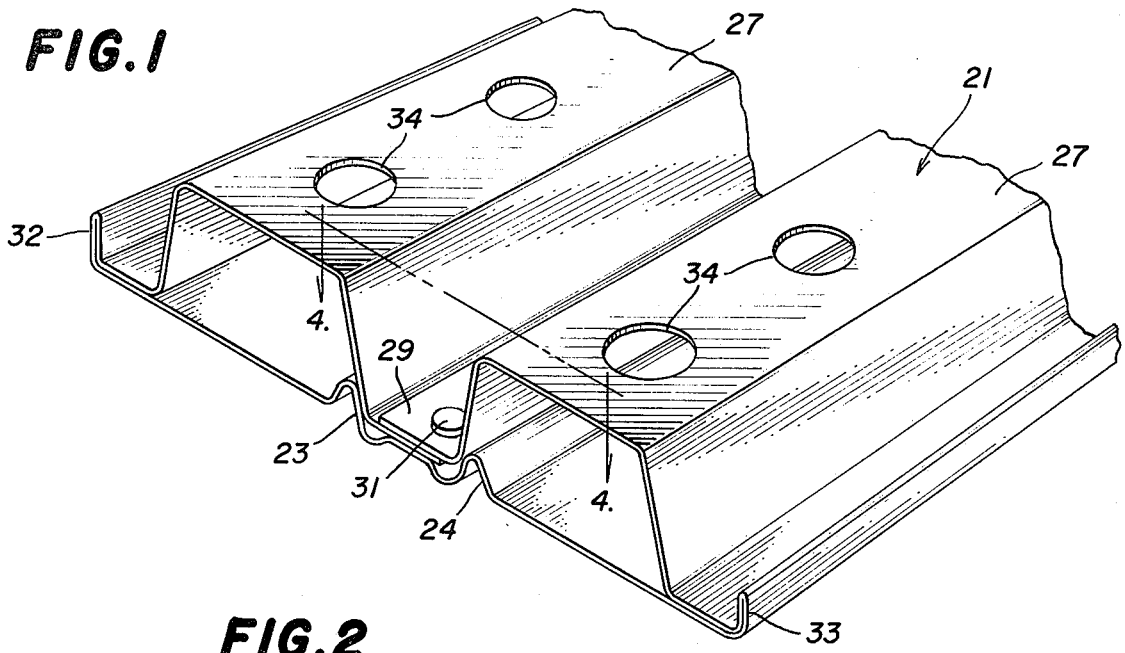
FIG. 1 is an isometric view of one embodiment of the invention formed of a single sheet of material.
Figure 2:
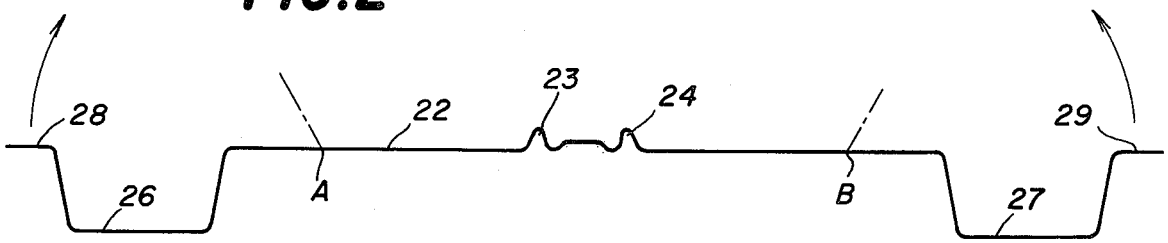
FIG. 2 is an end view of the sheet of material used to form the structure of FIG. 1 in an intermediate stage of fabrication.
Figure 4:
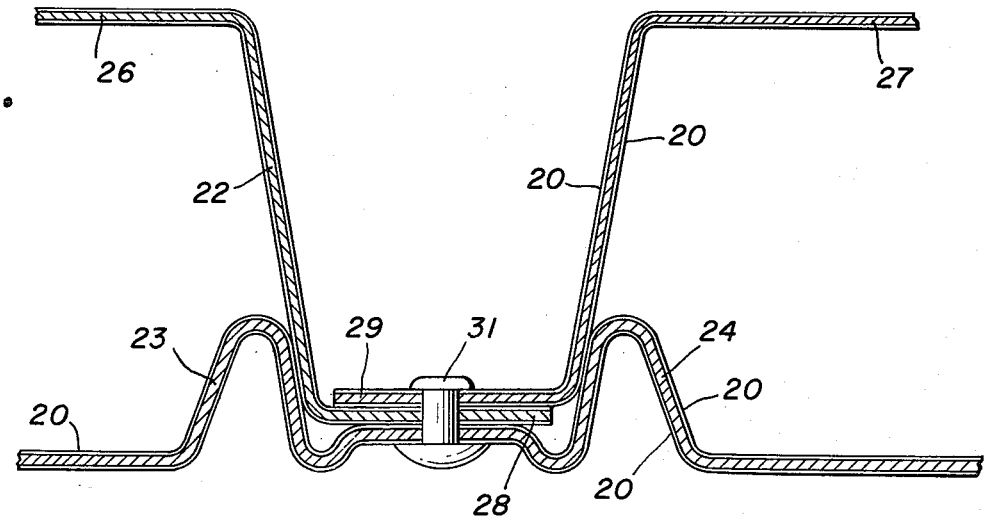
FIG. 4 is a partial section along the lines 4—4 of FIG. 1, showing the details of the coating and the means for fastening the ends of the sheet.

The embodiment shown in FIG. 6 is made from separate pieces of metal for the upper and lower plates of the assembly. In FIG. 1, there is shown a similar assembly 21 which is suitably made from a single sheet of metal which has been precoated on both sides as discussed above. As shown in FIG. 2 in an end view, the sheet 22, after precoating, is formed by conventional rolling techniques into the configuration shown, with a pair of stiffening ribs 23, 24 in the middle and a pair of troughs 26, 27 located near the free ends of the sheet. After the form shown in FIG. 2 has been obtained, the outer edges of the sheet are bent at the points A, B, in the inboard marginal portions adjacent the mouths of troughs 26 and 27, as indicated by the dotted lines, and the outboard ends folded onto the middle of the sheet with the outer flat marginal portions 28, 29 nesting one on top of the other between the ribs 23, 24 in the middle of the sheet. Completion of the assembly is made by securing one or more rivets 31 or similar fasteners to the overlapped sections between ribs 23, 24, as shown in detail in FIG. 4, which also depicts the protective coating 20 on all surfaces of sheet 22.

Figure 3:
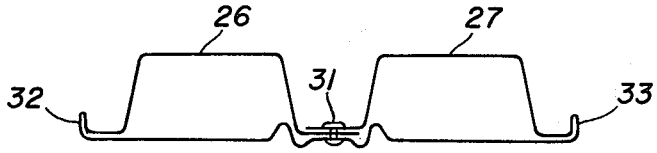
FIG. 3 is an end view of the embodiment of FIG. 2 after the ends have been folded over to form cells or raceways.

In a preferred embodiment, shown in FIG. 3, the marginal edges of the assembly, after folding, are bent to form vertical flanges 32, 33. These flanges serve to increase the stiffness of the structure and also to improve the bonding of the assembly to the concrete used in the usual installation.

Also shown in FIG. 1 are access openings 34 in the top surfaces of the individual cells. These access openings can be conveniently punched at the appropriate locations in the sheet prior to forming. In conventional fashion, the access openings may be closed with removable plates or other barriers against the entry of concrete when the assembly is installed in a floor.

Figure 5:
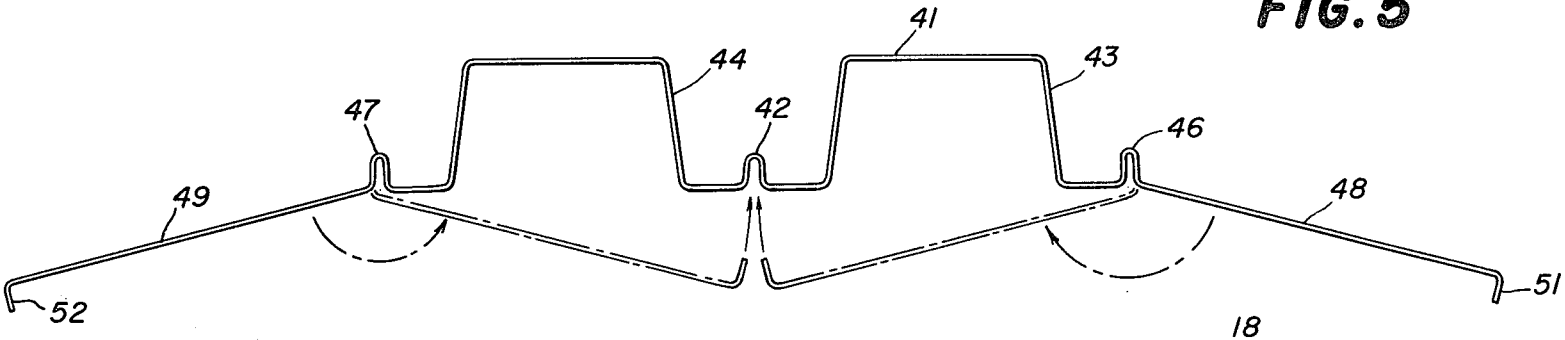
FIG. 5 is an end view of another embodiment of the invention, in which the assembly is formed from a single sheet of metal.
Figure 8:
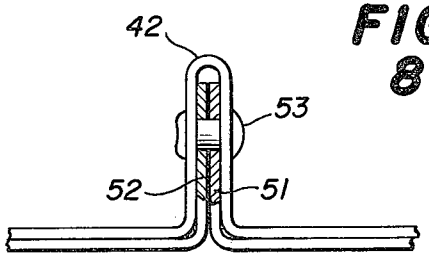
FIG. 8 is a detail of the fastening means used in the embodiment of FIG. 5 to attach the ends of the sheet to the central rib.

FIG. 5 depicts an alternative embodiment 40 of the invention which is also formed from a single sheet of metal. In this embodiment, the sheet 41 is rolled by conventional means into the configuration shown, comprising a vertical rib 42 in the middle of the sheet located between two inverted troughs 43, 44, with a pair of vertical ribs 46, 47 at the outboard sides of the troughs. The outer marginal portions 48, 49 of the sheet are bent at the edges of ribs 46, 47, causing depending flanges 51, 52 at the free edges of the sheet to enter the central opening of rib 42. The installation is completed by passing a horizontal rivet 53 or similar fastener through rib 42 and through both flanges 51, 52 as shown in detail in FIG. 8.

Figure 7:
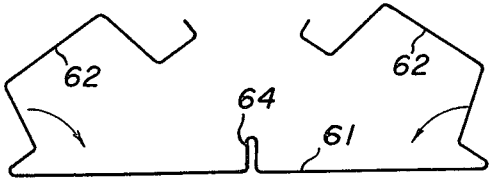
FIG. 7 is a schematic end view of another embodiment of the invention illustrating a different manner of fastening the ends of the sheet to the central rib thereof.

In a variation of the construction shown in FIG. 5, the sheet can be formed with the troughs near the outer marginal edges thereof. As shown schematically in FIG. 7, when sheet 61 is folded along fold lines inboard of troughs 62, flanges 63 formed along the edges of the sheet will abut against the sides of central rib 64. The structure is fastened by passing horizontal rivet-like fasteners through both of flanges 62 and the intermediate rib 64. To complete the construction, the outer marginal edges of the structure are advisably turned up to form marginal flanges (not shown) similar to those shown in FIG. 5.

Figure 9:
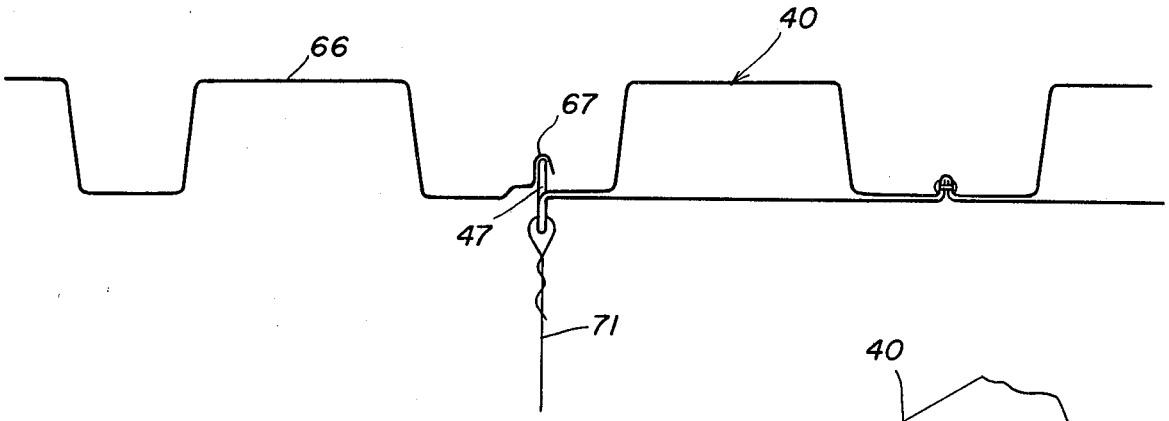
FIG. 9 is a schematic end view of a typical installation using the embodiment of FIG. 5 in conjunction with auxiliary forms which do not provide raceways, the installation being adapted for providing a vertical support means for objects to be suspended therefrom.
Figure 10:
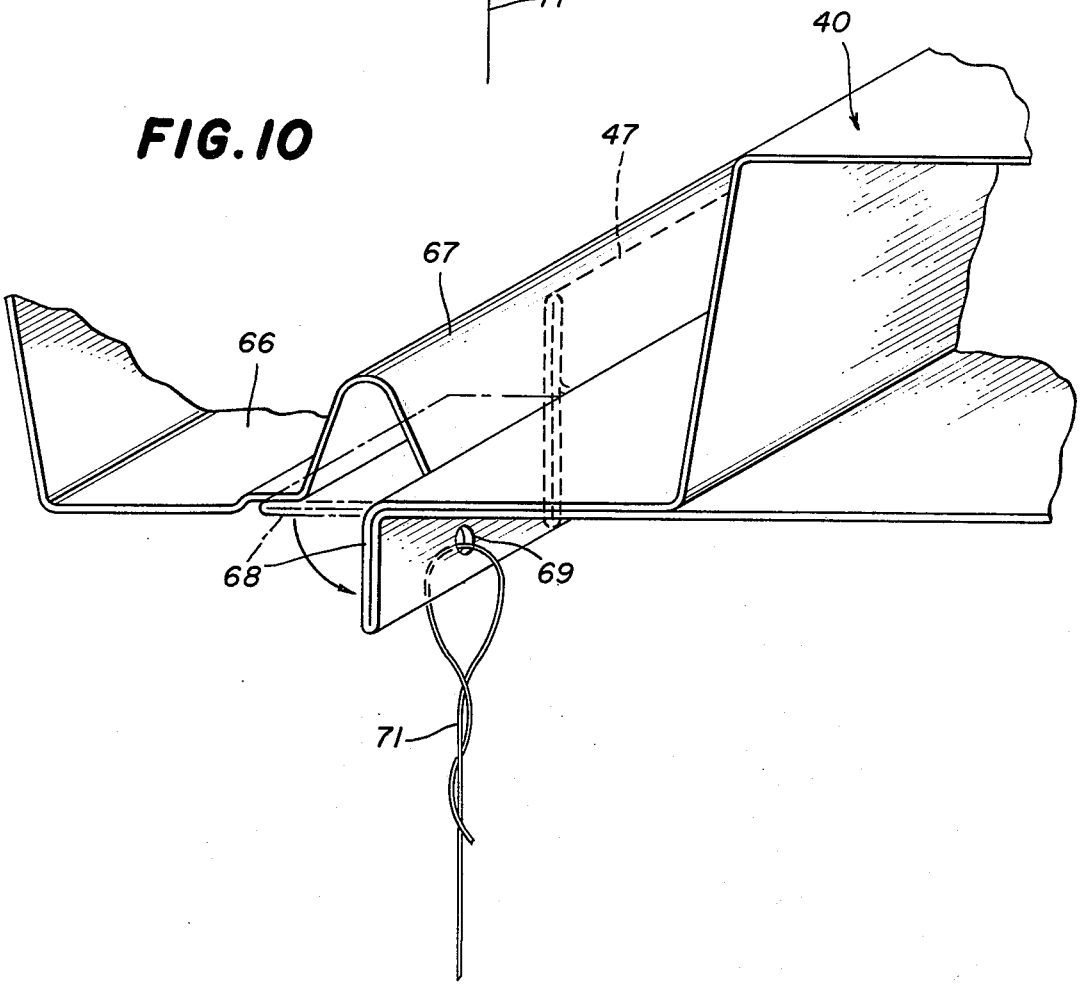
FIG. 10 is an isometric detail of the vertical support means incorporated in the embodiment of FIG. 9.

FIG. 9 is a schematic representation of a typical installation embodying a cellular assembly 40 such as that of FIG. 5, used in conjunction with a single auxiliary corrugated sheet 66 for those areas of the floor in which no cellular raceway structure is necessary or desired. In this case, auxiliary sheet 66 is provided with a curved edge 67 adapted to mate with flange 47 of cellular assembly 40. In the installation as shown in FIG. 10, a portion of flange 47 is cut and bent to a horizontal position as flap 68, indicated by dashed lines. After concrete has been poured onto the cellular structure, flap 68 can be bent to a vertical position and provided with an opening 69 through which a suspension member 71 can be affixed for use as necessary or desirable in the building construction. By using an assembly such as that shown in FIG. 10, a hanger system can be provided for the ceiling below the floor in which the cellular assembly of FIG. 9 is used.

The foregoing detailed description has been given for clearness of understanding only, and no unnecessary limitations should be understood therefrom as modifications will be obvious to those skilled in the art.

We claim:

1. A cellular floor panel assembly comprising:

a first plate and a second plate, at least one of said plates having a plurality of generally parallel troughs, the other of said plates covering the troughs of said one of said plates to define generally parallel enclosed cells, said plates having an electrically non-conductive protective coating on all surfaces, one of said plates being provided with at least one stiffening rib parallel to said cells, said rib being in contact with the other of said plates along a line of juncture between said plates, and fastening means holding said plates together comprising rivet-like fasteners passing through both of said plates in at least one area of contact therebetween.

2. The assembly of claim 1 in which said plates are integrally joined along a fold line at a marginal edge of said assembly.

3. The assembly of claim 2 in which said marginal edge is provided with a vertical flange.

4. The assembly of claim 3 in which a portion of said vertical flange extends from said edge in a direction opposite to that of the remainder of said flange.

5. A cellular floor panel assembly formed of a single metal sheet which is folded along a fold line to provide an upper section and a lower section, said fold line constituting a marginal edge of said assembly, said upper section having a free marginal edge and a fluted configuration defining at least one inverted trough having a flat marginal portion adjacent each side of the mouth thereof, said lower section covering the mouth of said trough to define an elongated enclosed cell, said sheet having a corrosion-resistant electrically non-conductive coating on both surfaces thereof;

said assembly including mechanical fastening means passing through both of said upper and lower sections in an area of contact therebetween.

6. The assembly of claim 5 in which said lower section is provided with at least one stiffening rib parallel to said cell in contact with said upper section at a juncture of said upper and lower sections.

7. The assembly of claim 6 in which said lower section is provided with a vertical flange spaced from said folded marginal edge of said assembly and said upper section is provided with a vertical flange along its free marginal edge, said flanges being in contact and said fastening means passing through both of said flanges.

8. A method for forming a cellular floor panel assembly comprising the steps of:

coating both sides of a flat metal sheet with a protective coating;

forming at least one longitudinally extending trough in said sheet, leaving flat marginal sections adjacent the edges of said trough;

folding one of said marginal sections over onto itself along a line parallel to said trough to cover the mouth of said trough, thus forming an elongated enclosed cell; and fastening the folded sections of said sheet together by means of a mechanical fastener passing through both sections of said folded sheet.

9. The method of claim 8 which includes the steps of forming a vertical flange along a free edge of one of said marginal sections;

forming a vertical rib in the interior of said sheet running generally parallel to said trough; and positioning said flange adjacent said rib and attaching said flange to said rib by means of a horizontally positioned rivet-like fastener passing through both of said lip and said rib.

10. The method of claim 8 which includes the step of forming in said sheet a longitudinally extending stiffening rib parallel to said trough, said rib being in contact with an edge of said trough when said sheet is folded.

* * * * *